US008746257B1

(12) United States Patent
Holmes

(10) Patent No.: US 8,746,257 B1
(45) Date of Patent: Jun. 10, 2014

(54) HAIR BRAIDS AND WEAVE TRACK TOOL REMOVER

(76) Inventor: Karen A Holmes, Houston, TX (US)

( * ) Notice: Subject to any disclaimer, the term of this patent is extended or adjusted under 35 U.S.C. 154(b) by 378 days.

(21) Appl. No.: 12/455,598

(22) Filed: Aug. 7, 2009

(51) Int. Cl.
*A45D 24/10* (2006.01)
*B26B 13/00* (2006.01)

(52) U.S. Cl.
USPC ..... 132/148; 30/233.5

(58) Field of Classification Search
USPC ..... 132/201, 213.1, 150, 148, 212, 149; 7/134–136, 161–162; 112/169, 222; 87/62
See application file for complete search history.

(56) References Cited

U.S. PATENT DOCUMENTS 158,054 A * 12/1874 Fawcett ..... 7/135
716,454 A * 12/1902 Martin ..... 7/136
976,674 A * 11/1910 Middletone ..... 7/135
3,840,948 A * 10/1974 Winfrey ..... 27/21.1
5,755,341 A * 5/1998 Spamer ..... 211/59.2
5,970,615 A * 10/1999 Wall ..... 30/195
6,065,213 A * 5/2000 Rivera ..... 30/155
6,092,535 A * 7/2000 Moore ..... 132/270
6,584,693 B2 * 7/2003 DeBolt ..... 30/232
7,252,093 B2 * 8/2007 Rodriguez ..... 132/201
7,273,057 B1 * 9/2007 Capaldo ..... 132/148
2007/0137049 A1 * 6/2007 Venzon ..... 30/232

* cited by examiner

*Primary Examiner* — Rachel Steitz
*Assistant Examiner* — Jennifer Gill

(57) ABSTRACT

A hair care tool to aid in the installation, care, and removal of hair braids and weaves comprising a long slender shaft approximately one (1) foot long with a handle grip in the middle is herein disclosed. While the exact configuration of the tool is envisioned to vary depending on the model, each end comprises a specific tool to aid in the installation, care and removal of hair braids and weaves. Said tools are envisioned to include a hook at each end for removal of micro braids and removing braiding tracks, a scissor configuration for cutting thread associated with hair weaves, and a comb for combing out the weave track. Each tool is envisioned to vary in size according the style of hair. The features of the tool are envisioned to speed various hair care processes thus saving time for a private user or professional beautician.

1 Claim, 1 Drawing Sheet

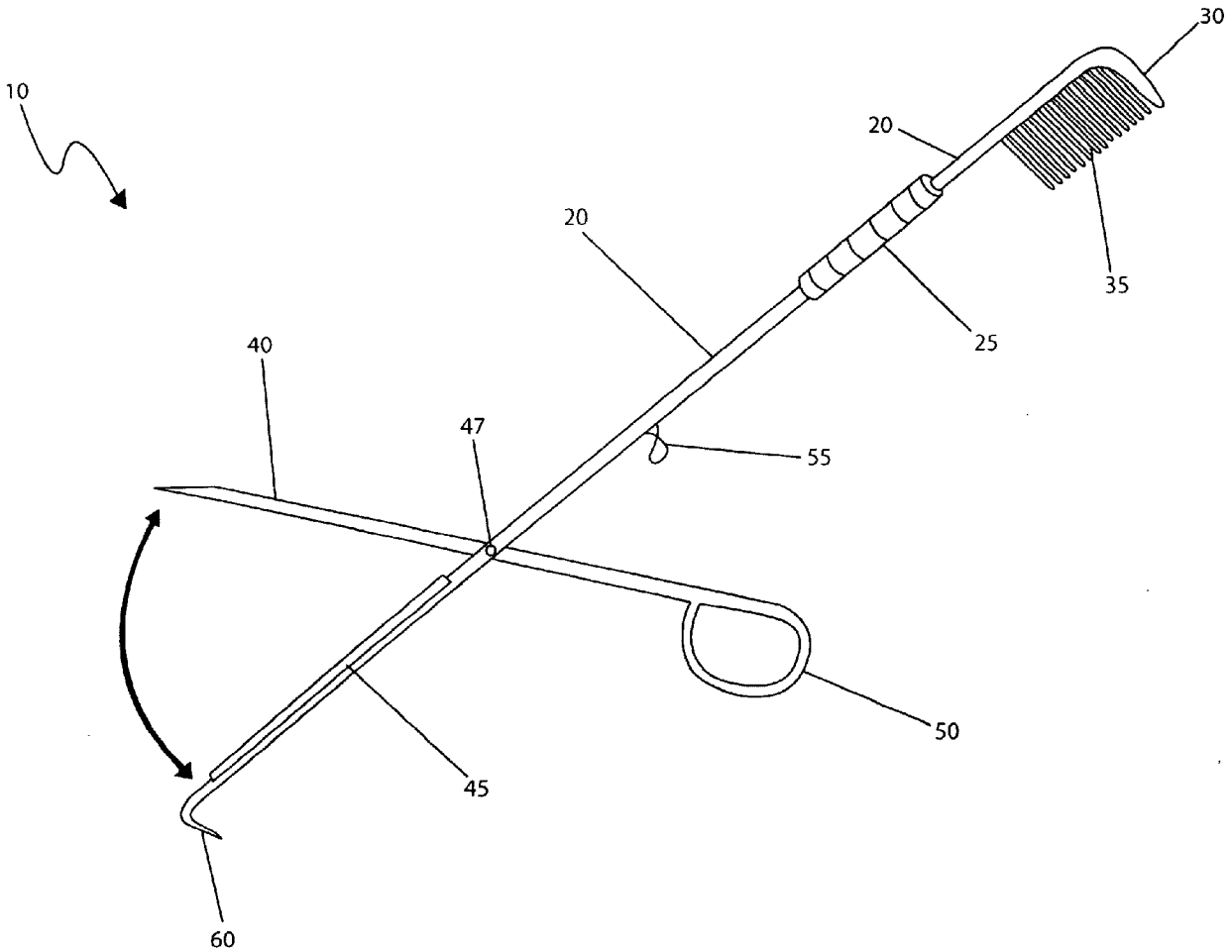
30
35
20
25
20
55
47
40
10
50
45
60

HAIR BRAIDS AND WEAVE TRACK TOOL REMOVER

BACKGROUND OF THE INVENTION

The present invention relates generally to a device for removing and cutting hair weaves, braids and thread from the hair, more particularly, to a device that combines several tools for the aid of removing micro-braiding and hair weaves into one device. This device will aid a user in the installation, care, and removal of hair braids and weaves comprising a long slender shaft approximately one foot long with a handle grip at and intermediate position. While the exact configuration of the device is envisioned to vary depending on the model, the two shaft ends comprise a first hook and a second hook having differing geometry to aid in the removal of micro braids and weaves. Additional integral features include a scissor blade for cutting thread associated with hair weaves and a comb for combing out weave track. Each model of the device is envisioned to vary in size according to particular hair styles. The features of the device are envisioned to speed a hair care process thus saving time for private users and professional beauticians.

The field of hair design involves the styling of hair for a unique look craved by consumers. Many of these hair styles involve intricate work with hair weaves and micro-braiding. There are literally thousands of hair styling and maintenance products on the market today that aid in producing these styles. Due to the fact that the hair styling industry at the salon level is highly competitive in nature and the ability to produce any particular style effectively and efficiently is directly related to the success of that business, there is a constant need for new and innovative hair styling accessory designs that will simplify or make the processes involved easier to speed all hair care processes thus saving time for the private user and associated money for the professional beautician.

BRIEF DESCRIPTION OF THE DRAWING

The advantages and features of the present invention will become better understood with reference to the following more detailed description and claims taken in conjunction with the accompanying drawing, in which like elements are identified with like symbols, and in which:

FIG. 1 is a front perspective view of a hair braids and weave track remover tool 10, according to a preferred embodiment of the present invention.

| | |
|---|---|
| 10 | hair braids and weave track Remover tool |
| 20 | shaft |
| 25 | grip |
| 30 | first hook |
| 35 | comb |
| 40 | scissor |
| 45 | cutting edge |
| 55 | scissor clip |
| 60 | second hook |

SUMMARY OF THE INVENTION

The best mode for carrying out the invention is presented in terms of its preferred embodiment, herein depicted within FIG. 1

DETAILED DESCRIPTION OF THE INVENTION

The best mode for carrying out the invention is presented in terms of its preferred embodiment, herein depicted within FIG. 1. However, the invention is not limited to the described embodiment, and a person skilled in the art will appreciate that many other embodiments of the invention are possible without deviation from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a hair braids and weave track remover tool (herein described as the "device") 10 to aid a user in the installation, care, and removal of hair braids and weaves comprising a long slender shaft 20 approximately one (1) foot long with a handle grip 25 at an intermediate position. While the exact configuration of the device 10 is envisioned to vary depending on the model, the two (2) shaft ends comprise a first hook 30 and a second hook 60 having differing geometry to aid in the removal of micro braids and weaves. Additional integral features include a scissor blade 40 for cutting thread associated with hair weaves and a comb 35 for combing out weave track. Each model of the device 10 is envisioned to vary in size according to particular hair styles. The features of the device 10 are envisioned to speed a hair care process thus saving time for private users and professional beauticians.

Referring now to FIG. 1, a front perspective view of the device 10, according to the preferred embodiment of the present invention, is disclosed. The device 10 comprises a shaft 20, a grip 25, a first hook 30, a comb 35, a scissor 40, a cutting edge 45, a scissor clip 55, and a second hook 60. The shaft 20 comprises a linear solid or hollow metal rod approximately one-quarter (¼) of an inch in diameter providing easy single-handed manipulation by a user in a similar manner as a pencil. The shaft 20 provides an attachment means thereto a cylindrically-shaped grip 25 approximately two (2) to three (3) inches long located slightly above an intermediate position along said shaft 20. The grip 25 provides improved grasping by a user during use and is envisioned to be made using high-friction materials and compounds such as vulcanized natural rubber, latex, or the like, being affixed thereto said shaft 20 using molding processes, adhesives, or the like. The shaft 20 further comprises a first hook 30 located at a proximal end thereof. The first hook 30 forms a right angle therewith the shaft 20 extending therefrom approximately one-half (½) inch terminating in a slightly rounded point. The first hook 30 provides an aid for hooking and pulling out particular hair styling designs such as corn rows, weave tracks, and the like. The shaft 20 also provides and attachment means thereto a second hook 60 at a distal end thereof. The second hook 60 comprises a thinner and smaller hook if compared thereto the first hook 30, thereby enabling a user to hook and pull yet even finer hair styling features associated therewith micro braids and the like. The second hook 60 extends perpendicularly approximately one-quarter (¼) of an inch therefrom the shaft and tapers to a point. It is envisioned that the first 30 and second 60 hooks provide sufficient versatility to a user while pulling out particular hair styles so as to avoid numerous occurrences of putting down and picking up various hair care tools resulting in a significant saving of time. The shaft 20 further provides an attachment means thereto an integral scissor 40 via a scissor pivot 47 located along a one-third (⅓) of the distal portion of the shaft 20. The scissor 40 is radially attached thereto the scissor pivot 47 rotating and extending in either direction in an expected manner. The scissor 40 further comprises expected features such as, but not limited to: Operated loop 50, a protruding scissor clip 55 to secure the scissor safely thereto the shaft 20 when not in use, and a machined cutting edge along a lower half thereof. The shaft 20 provides a second machined cutting edge 45 being adjacent thereto the second hook 60 which corresponds thereto, and Works in conjunction therewith, the cutting edge portion of the scissor 40 in an expected manner, thereby allowing a user to cut threads associated with various hair weaving tracks without reaching for a separate scissor. Adjacent thereto the first hook 30 is a small hard tooth comb 35. The teeth of the comb 35 are envisioned to be similar in length to the first hook 30 and extend approximately one (1) inch down the shaft 20. The comb 35 allows a user to comb out weave track, braids, corn rows, and other styling features. The shaft 20, scissor 40, hooks 30, 60, and comb 35 are envisioned being made using sturdy metal materials such as stainless steel being produced in a stamping or machining process common in the industry.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be utilized as indicated in FIG. 1.

The method of utilizing the device 10 may be achieved by performing the following steps: grasping the device 10 around the shaft 20 using one (1) hand by squeezing around the grip 25; using the scissor 40 to cut threads associated with various hair weaving tracks and other styles without reaching for a separate scissor; securing the scissor 40 when finished in a safe manner thereto the shaft 20 using the scissor clip 55; hooking and pulling out particular hair styling designs such as corn rows and weave tracks using the first hook 30; hooking and pulling out micro braids using the second hook 60; combing out the aforementioned hair style features using the comb 35 until obtaining a desired result; and, benefiting from time saved using a multi-function device 10 rather than having to repeatedly pick up and return several separate hair care tools while performing various repetitious hair styling tasks.

An alternative embodiment of the present invention 10 comprises different size models of the device 10 corresponding to particular hair styles as well as a particular user's preference.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A scissor hair styling tool comprising two arms, wherein a first arm comprises a finger receiving loop (5) on a proximal end of the first arm and a first cutting blade (40) located on a distal end of the first arm with a hinge pivot (47) located centrally between the finger loop and first cutting blade; a second arm, hingedly connected to the first arm, a comb (30) having a plurality of teeth (35) projects from a proximal end of the second arm and a second cutting blade (45) that works in conjunction with the first blade to form scissors located at a distal end of the second arm, wherein the second cutting blade comprises a hooked end (60) with a shaft (20) projecting therefrom, wherein the comb teeth project in a direction that is the same as the hook, and a grip (25) projects from the second arm between the hinge connection and the comb.

* * * * *